US007507883B2

(12) United States Patent
Ooi

(10) Patent No.: US 7,507,883 B2
(45) Date of Patent: Mar. 24, 2009

(54) ELECTRONIC KEYBOARD INSTRUMENT

(75) Inventor: Susumu Ooi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/850,601

(22) Filed: Sep. 5, 2007

(65) Prior Publication Data

US 2008/0066605 A1 Mar. 20, 2008

(30) Foreign Application Priority Data

Sep. 15, 2006 (JP) ..... 2006-251034

(51) Int. Cl.
*G10C 3/02* (2006.01)

(52) U.S. Cl. ..... 84/178; 84/179; 84/180; 84/181; 84/423 R

(58) Field of Classification Search ..... 84/178–181, 84/423 R
See application file for complete search history.

(56) References Cited

U.S. PATENT DOCUMENTS

| | | | | | |
|---|---|---|---|---|---|
| 303,119 | A * | 8/1884 | Clark | 84/179 |
| 495,122 | A * | 4/1893 | Schimmel et al. | 84/179 |
| 602,808 | A * | 4/1898 | Kracht | 84/179 |
| 1,242,952 | A * | 10/1917 | La Joie | 84/179 |
| 2,493,168 | A * | 1/1950 | Schroth | 84/179 |
| 3,100,415 | A * | 8/1963 | Andersen | 84/177 |
| 3,981,221 | A * | 9/1976 | Wittel | 84/423 R |
| 4,593,593 | A * | 6/1986 | Bellini | 84/177 |
| 4,693,525 | A * | 9/1987 | Shinoto | 312/208.4 |
| 5,076,129 | A * | 12/1991 | Wakuda | 84/179 |
| 5,429,026 | A * | 7/1995 | Kimura et al. | 84/179 |
| 5,433,131 | A * | 7/1995 | Suzuki | 84/179 |
| 5,487,321 | A * | 1/1996 | Kimura et al. | 84/423 R |
| 5,918,295 | A * | 6/1999 | Mueth | 84/177 |
| 5,973,241 | A * | 10/1999 | Tetsumura | 84/179 |
| 6,353,163 | B2 * | 3/2002 | Suzuki | 84/179 |
| 6,673,991 | B2 * | 1/2004 | Hara | 84/179 |
| 2007/0221037 | A1 * | 9/2007 | Saito et al. | 84/177 |
| 2008/0066605 | A1 * | 3/2008 | Ooi | 84/177 |

FOREIGN PATENT DOCUMENTS

| | | |
|---|---|---|
| JP | 45-33494 | 12/1970 |
| JP | 54-133834 | 9/1979 |
| JP | 7-49511 | 11/1995 |

* cited by examiner

*Primary Examiner*—Walter Benson
*Assistant Examiner*—Robert W Horn
(74) *Attorney, Agent, or Firm*—Morrison & Foerster LLP

(57) ABSTRACT

A musical instrument body is provided with an array of keys at a front portion of the musical instrument body, and side plates at both side portions of the musical instrument body. A keyboard lid is mounted in the musical instrument body slidably between a closed position for covering the array of the keys and an open position for exposing the array of the keys. In case that the keyboard lid is shifted to the open position from the closed position, a front lid section moves rearward along a first guide recess together with a rear lid section, and when the rear lid section reaches a rearmost position, a rear lid supporting part is positioned in a second guide recess, while a front lid supporting part moves from the first guide recess to a third guide recess at a branch point according to release of connection between the front lid section and the rear lid section, and subsequently the front lid section is guided along the third guide portion.

7 Claims, 7 Drawing Sheets

ELECTRONIC KEYBOARD INSTRUMENT

BACKGROUND OF THE INVENTION

1. Technical Field of the Invention

The present invention relates to an electronic keyboard instrument, such as an electronic piano, an electronic organ, or the like. In this specification and claims, a proximal portion of an electronic instrument and a keyboard device thereof to a player is defined as a front portion, and a distal portion from a player is defined as a rear portion.

2. Description of the Related Art

Most electronic keyboard instruments are equipped with a keyboard lid for covering a keyboard, which performs an opening/closing operation by sliding in a front/rear direction (namely, depth direction of the keyboard device). Examples of conventional keyboard lid structures are disclosed in Patent References 1 to 3.

Patent Reference 1 discloses a structure in which guide recesses are provided along side plates of a keyboard instrument, and rear portions of both side ends of a keyboard lid are supported in the guide recesses to slide forward and backward. In this structure, a key-covering portion of the keyboard lid is configured as one piece of a flat plate-shaped member, hence a portion for receiving the keyboard lid is needed to have the same depth as the keyboard lid. There is a problem in that the depth of the whole keyboard instrument becomes large.

Patent Reference 2 discloses a structure in which narrow and long plate members extending in a key arranging direction are connected to each other to form a keyboard lid, and the keyboard lid can be bent at the connecting portions of the plate members. When opening the keyboard lid, the keyboard lid moves in a rear-downward direction of a musical instrument body while being bent. By such a keyboard lid, the depth of the whole musical instrument can be reduced to a certain extent. However, a space into which the keyboard lid is introduced is needed to be provided at a rear portion of the keyboard, hence size compactness is not achieved sufficiently.

Patent Reference 3 discloses a structure in which a keyboard lid is divided into a front section and a rear section, and an upper guide recess and a lower guide recess are provided on both side plates to respectively guide the front section and rear section of the keyboard lid. According to this structure, when opening the keyboard lid, the front section and the rear section of the keyboard lid overlap up and down and are received together in a rear portion of a musical instrument. Therefore, the depth of the whole musical instrument can be reduced considerably. The front section and the rear section of the keyboard lid are respectively provided with metal connecting fittings at rear portions thereof. When pushing the front and rear sections of the keyboard lid to an opening position, the metal connecting fittings are pressed and elastically deformed to be engaged with each other, so that when drawing back the front section, the rear section interlocks with the front section. However, if drawing back the front section in the middle of opening the keyboard lid, the engagement of the metal connecting fittings by the press is not made. Accordingly, although drawing back the front section, the rear section does not interlock with the front section, and thus the front and rear sections cannot cover the keyboard adequately.

[Patent Reference 1] Japanese Utility Model Examined Publication No. H7-49511

[Patent Reference 2] Japanese Utility Model Laid-Open Publication No. S54-133834

[Patent Reference 3] Japanese Utility Model Examined Publication No. S45-33494

SUMMARY OF THE INVENTION

Therefore, the present invention has been made in view of the above problems, and it is an object of the present invention to provide an electronic keyboard instrument that can be reduced to a small depth and can close a keyboard lid adequately from any position in the middle of opening the keyboard lid or a totally opened position.

In accordance with the present invention, the above and other objects can be accomplished by the provision of an electronic keyboard instrument comprising: a musical instrument body which is provided with an array of keys at a front portion of the musical instrument body, and side plates at both side portions of the musical instrument body; and a keyboard lid which is mounted in the musical instrument body slidably between a closed position for covering the array of the keys and an open position for exposing the array of the keys. The keyboard lid comprises a front lid section and a rear lid section which is arranged rearward of the front lid section in the closed position, and a connecting part which has connecting pieces respectively provided at the front lid section and the rear lid section to releasably connect the front lid section and the rear lid section to each other. The front lid section is provided with a front lid supporting part at each side end of the front lid section, and the rear lid section is provided with a rear lid supporting part at each side end of the rear lid section. Each of the side plates is formed with a guide recess which extends from a front portion of the side plate to a rear portion of the side plate, and which receives the front lid supporting part and the rear lid supporting part to slidably support the keyboard lid. The guide recess comprises a first guide portion which is formed at the front portion of each of the side plates, a second guide portion which extends rearward from a branch point provided at a rear end of the first guide portion, and a third guide portion which extends rearward from the branch point below the second guide portion. Under a state where the keyboard lid is placed in the closed position, the front lid supporting part and at least a portion of the rear lid supporting part are received in the first guide portion. In case that the keyboard lid is shifted to the open position from the closed position, the front lid section moves rearward along the first guide portion together with the rear lid section, and when the rear lid section reaches a rearmost position, the rear lid supporting part is positioned in the second guide portion, while the front lid supporting part moves from the first guide portion to the third guide portion at the branch point according to release of the connection between the front lid section and the rear lid section by the connecting part, and subsequently the front lid section is guided along the third guide portion. In case that the keyboard lid is shifted to the closed position from the open position, the front lid section moves forward, and when the front lid supporting part advances into the first guide portion from the third guide portion, the front lid section is connected to the rear lid section by the connecting part, and the rear lid supporting part enters into the first guide portion following the front lid section, so that the front lid section and the rear lid section are guided along the first guide portion.

Preferably, the front lid supporting part comprises a front lid-front supporting part and a front lid-rear supporting part which are respectively mounted to a front portion and a rear portion of each side end of the front lid section, and the rear lid supporting part comprises a rear lid-front supporting part and a rear lid-rear supporting part which are respectively mounted to a front portion and a rear portion of each side end of the rear lid section. Under the state where the keyboard lid is placed in the closed position, the front lid-front supporting part, the front lid-rear supporting part and the rear lid-front supporting part are received in the first guide portion, and the rear lid-rear supporting part is received in the first guide portion or the second guide portion. In case that the keyboard lid is shifted to the open position from the closed position, the rear lid section reaches the rearmost position to open the keyboard lid, and the rear lid-rear supporting part and the rear lid-front supporting part are positioned in the second guide portion, then the front lid-rear supporting part moves to the third guide portion from the branch point according to the release of the connection between the front lid section and the rear lid section by the connecting part, and subsequently the front lid section. is guided along the third guide portion. In case that the keyboard lid is shifted to the closed position from the open position, the front lid-rear supporting part enters into the first guide portion from the third guide portion by moving the front lid section forward to close the keyboard lid, the front lid section is connected to the rear lid section to establish a connection state by the connecting part, and the rear lid-front supporting part enters into the first guide portion following the front lid section under the connection state, so that the front lid section and the rear lid section are guided along the first guide portion.

Preferably, the third guide portion slants downward from the branch point and then extends rearward. In case that the keyboard lid is shifted from the closed position to the open position, the front lid-rear supporting part descends to the third guide portion at the branch point, and the connection between the front lid section and the rear lid section by the connecting part is released due to the descending of the front lid-rear supporting part. In case that the keyboard lid is shifted from the open position to the closed position, the front lid-rear supporting part ascends from the third guide portion and enters into the first guide portion, and the connection between the front lid section and the rear lid section by the connecting part is established due to the ascending of the front lid-rear supporting part.

Preferably, the connecting part comprises a front connecting piece which is mounted to each of both side ends of the front lid section, and a rear connecting piece which is mounted to each side end of the rear lid section, the front connecting piece can be engaged with and separated from the rear connecting piece, the front connecting piece being connected to the rear connecting piece to draw the rear connecting piece forward in an engagement state, and otherwise being separated downward from the rear connecting piece. The front connecting piece supports the rear lid-front supporting part from the below to prevent the rear lid-front supporting part from descending to the third guide portion when the rear lid-front supporting part is positioned in the branch point, and is disposed such that when the front lid-rear supporting part descends to the third guide portion from the branch point, the front connecting piece is separated from the rear connecting piece simultaneously with the descending of the front portion of the front lid section.

Preferably, the front lid section and the rear lid section are stored in a rear portion of the musical instrument body when the keyboard lid is placed in the open position, in such a manner that the front lid section and the rear lid section overlap with each other.

In the keyboard device of the electronic keyboard instrument according to the present invention, as described above, the keyboard lid is composed of the front lid section, the rear lid section, and the connecting part which connects the front lid section and the rear lid section. The front lid section and the rear lid section are provided with the supporting parts at both the respective side ends, and each of the supporting parts is guided by the guide recess which is provided at each of the side plates and extends in the front/rear direction. Accordingly, when opening the keyboard lid, the front lid section is received in the rear portion of the musical instrument while being positioned below the rear lid section. As a result, the space for receiving the keyboard lid becomes small, and the depth of the musical instrument can be shortened.

For the sake of the above lid-receiving structure, the guide recess is divided into the first guide portion which is provided at the front portion of each of the side plates, the second guide portion which extends rearward from the branch point provided at the rear end of the first guide portion, and the third guide portion which extends rearward and below the second guide portion from the branch point. When opening the keyboard lid, the front lid section follows the rear lid section and moves rearward, and when the rear lid section reaches the rearmost position, the supporting part of the rear lid section is positioned in the second guide portion, the supporting part of the front lid section moves to the third guide portion from the first guide portion according to the release of the connection by the connecting part, and the front lid section is guided along the third guide portion by the continuous movement. As a result, the front lid section is received in the musical instrument while being positioned below the rear lid section.

When closing the keyboard lid, the front lid section moves forward, and when the front lid supporting part advances into the first guide portion from the third guide portion, the front lid section is connected to the rear lid section by the connecting part, and the rear lid supporting part advances into the first guide portion by the movement in the connection state, so that the front lid section and the rear lid section are guided along the first guide portion.

As described above, when the rear lid section reaches the rearmost position to open the keyboard lid, the front lid supporting part moves from the first guide portion to the third guide portion. At this time, the connection by the connecting part is released. When the front lid supporting part moves from the third guide portion to the first guide portion to close the keyboard lid, the connection by the connecting part is established. Accordingly, when reversing the keyboard lid to close the keyboard in the middle of opening the keyboard lid, even though the connection by the connecting part has been released, the connection is successfully restored by the movement of the front lid supporting part, and the front lid section and the rear lid section interlock with each other. As a result, the keyboard lid can be closed adequately without trouble from any position in the middle of opening the keyboard lid or a totally opened position.

DETAILED DESCRIPTION OF THE INVENTION

Figure 1:
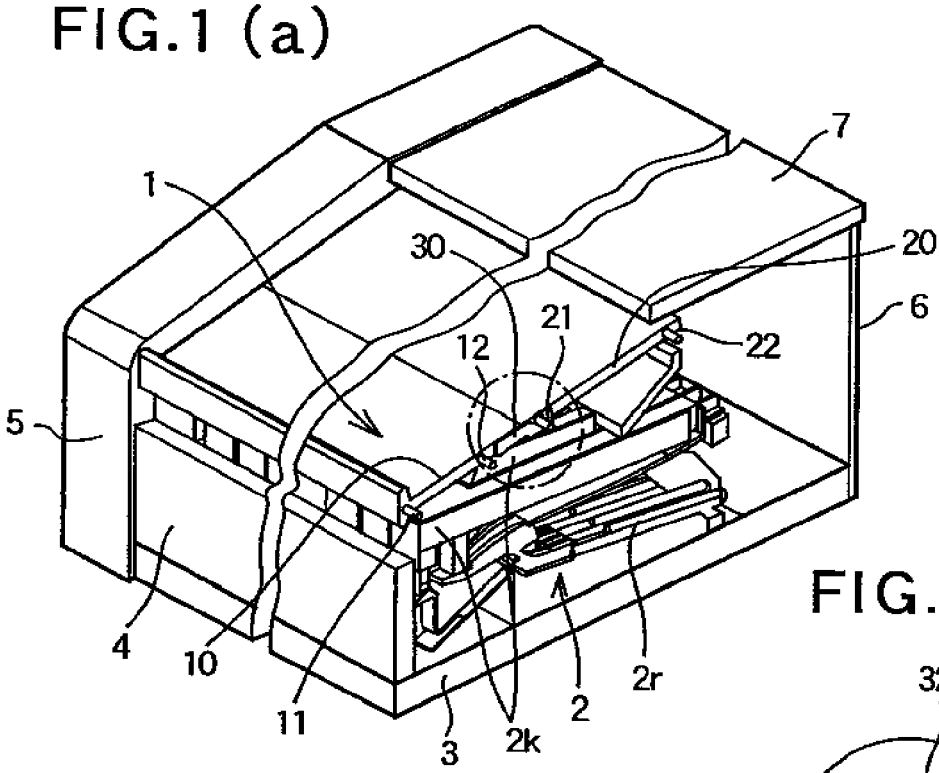
FIG. 1 is a view showing a keyboard and a keyboard lid of an electronic keyboard instrument in accordance with a first embodiment of the present invention, with exclusion of a side plate of a front side, FIG. 1(*a*) is a perspective view showing a state that the keyboard lid is closed, and FIG. 1(*b*) is an enlarged view of a connecting part depicted in FIG. 1(*a*).
Figure 1:
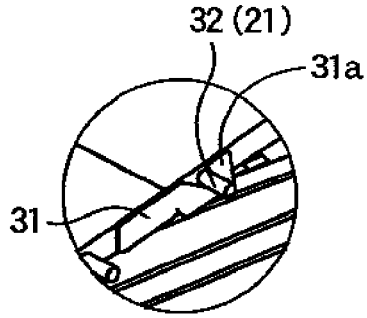

Various embodiments of the present invention will now be described in detail with reference to the accompanying drawings. The same or like components will be denoted by the same reference numerals throughout the drawings.

Figure 2:
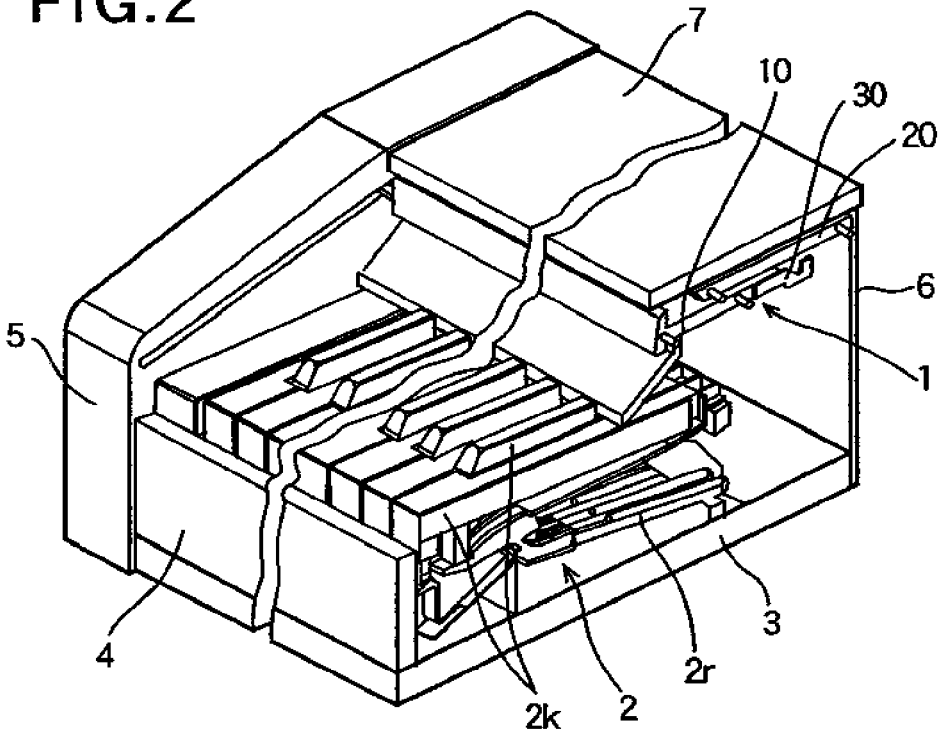
FIG. 2 is a perspective view showing a state that the keyboard lid is opened in the electronic keyboard instrument depicted in FIG. 1.

FIG. 1(*a*) and FIG. 2 show a keyboard and a keyboard lid of an electronic keyboard instrument in accordance with a first embodiment of the present invention, with exclusion of a side plate of a front side. FIG. 1(*a*) shows a state in which the keyboard lid is closed, and FIG. 2 shows a state in which the keyboard lid is opened. FIG. 1(*b*) is an enlarged view of a connecting part depicted in FIG. 1(*a*). Also, FIG. 1(*a*) shows the musical instrument which is partially cut away in a key arranging direction.

The electronic keyboard instrument includes a keyboard device 2 which has a keyboard 2*k* and an interlocking member 2*r* and outputs a sound generating signal when pressing keys, a shelf plate 3 which supports the keyboard device, a clapper part 4 which is coupled to a front end of the shelf plate, side plates 5 which are disposed at both side portions of the keyboard device, a rear plate 6 which shields a rear surface of the keyboard device, a top plate 7 which covers a rear upper portion of the keyboard device, and a keyboard lid 1 which covers an upper portion of the keyboard. The illustration of leg parts maintaining the keyboard position at a predetermined height, a speaker emitting sound, and a sound control device is omitted.

As shown in the drawing, the keyboard lid 1 includes a front lid section 10 and a rear lid section 20 which are arranged in the front/rear direction in a closed state, and a connecting part 30 which separably connects the front and rear lid sections. The front lid section 10 is provided with front lid-front shafts (front lid-front supporting parts) 11 at front portions of both side ends, and front lid-rear shafts (front lid-rear supporting parts) 12 at rear portions of both the side ends. The rear lid section 20 is provided with rear lid-front shafts (rear lid-front supporting parts) 21 at front portions of both side ends, and rear lid-rear shafts (rear lid-rear supporting parts) 22. at rear portions of both the side ends. Each of the side plates 5 is provided with a guide recess 50 at an inner surface, which extends in the front/rear direction and receives each of the shafts (supporting parts). The shafts 11, 12, 21 and 22 are formed as a pin which protrudes sideward from a side wall of each of the lid sections. Besides the pin shape, the shafts may be configured as other structures that can move along the guide recess 50, e.g., a slide piece which can move in the guide recess 50, or a structure that a roller is rotatably mounted to a shaft protruding sideward.

The connecting part 30 includes front connecting pieces 31 which are mounted to both the side ends of the front lid section, and rear connecting pieces 32 which are mounted to both the side ends of the rear lid section. In this embodiment, the front connecting pieces 31 are formed as a flat plate which is fixed to the side wall of the front lid section 10 and protrudes rearward, and the protruding portion is formed as a hook which is opened upward. The aforesaid rear lid-front shafts 21 also serve as the rear connecting pieces 32. By the above structure, the front connecting pieces 31 can be engaged with and separated from the rear connecting pieces 32 (rear lid-front shafts 21). In the engagement state, the front connecting pieces 31 are connected to the rear connecting pieces 32 so as to pull the rear connecting pieces 32 forward. The front connecting pieces 31 can be separated downward from the rear connecting pieces 32 from the engagement state. The hooks of the front connecting pieces 31 are positioned so as to be caught by the rear connecting pieces 32 (rear lid-front shafts 21) when the rear end of the front lid section 10 contacts the front end of the rear lid section 20.

Figure 3:
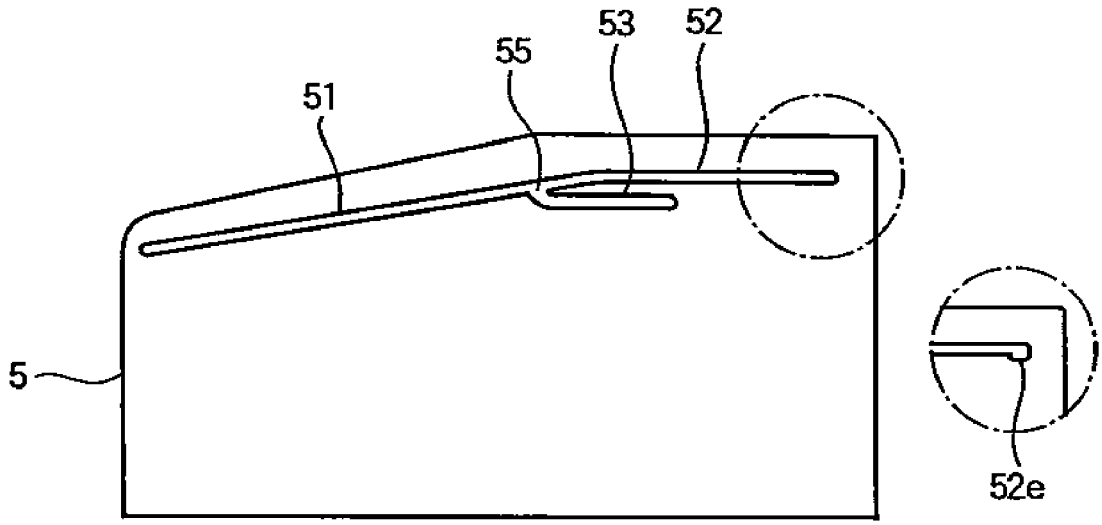
FIG. 3 is a side view of a side plate of the electronic keyboard instrument depicted in FIG. 1.

As shown in FIG. 3, the guide recess 50 includes a first guide portion 51 which is provided at the front portion of the side plate 5, a second guide portion 52 which extends rearward from a branch point 55 at the rear end of the first guide portion 51, and a third guide portion 53 which extends rearward and below the second guide portion 52 from the branch point 55. In this embodiment, the first guide portion 51 is slanted upward from the front to the rear along an uppermost side of the side plate 5, the second guide portion 52 extends shortly upward from the branch point 55 in the extending direction of the first guide portion 51 and then extends horizontally, and the third guide portion 53 is refracted from the branch point 55 in the slant rear-downward direction and then extends horizontally.

Figure 4:
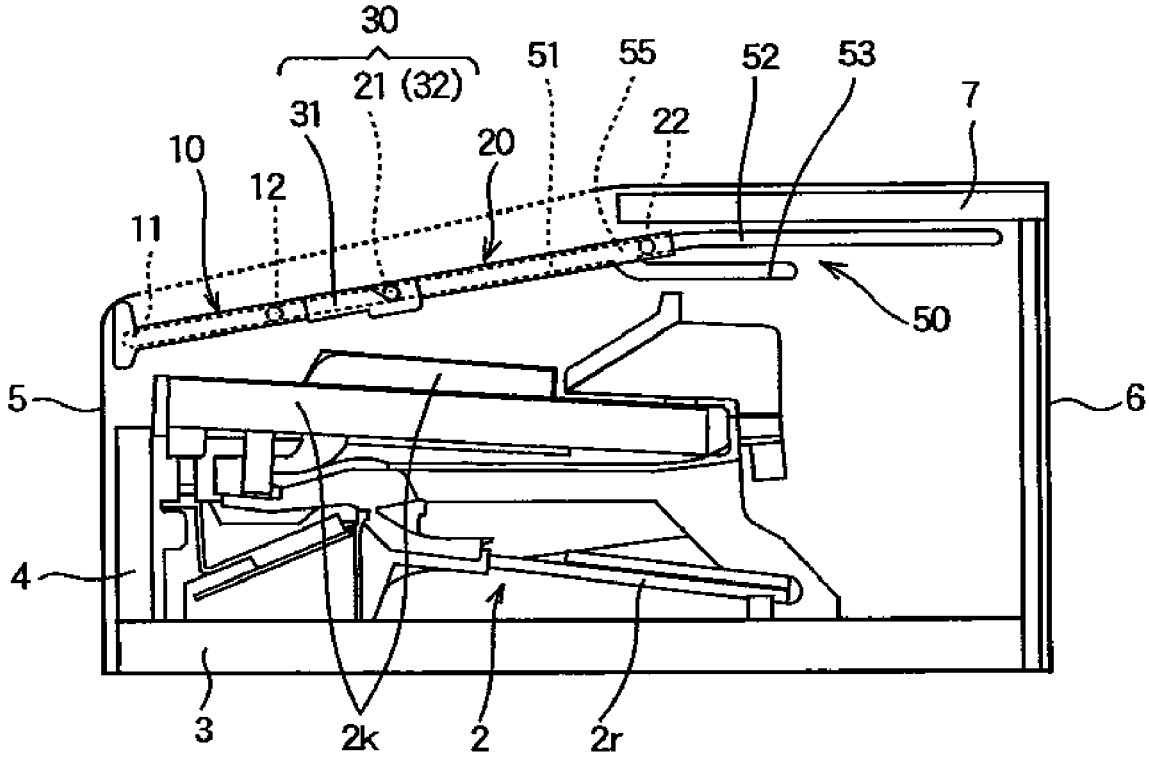
FIG. 4 is a longitudinal side sectional view of the electronic keyboard instrument depicted in FIG. 1, which shows a state that the keyboard lid is closed.
Figure 5:
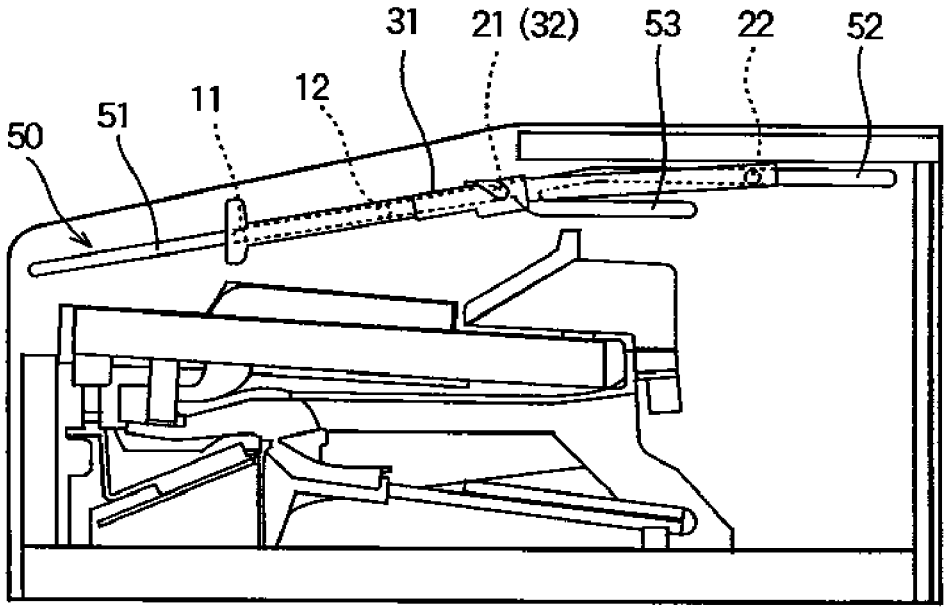
FIG. 5 is a longitudinal side sectional view of the electronic keyboard instrument depicted in FIG. 1, which shows a state that the keyboard lid is slightly opened.
Figure 6:
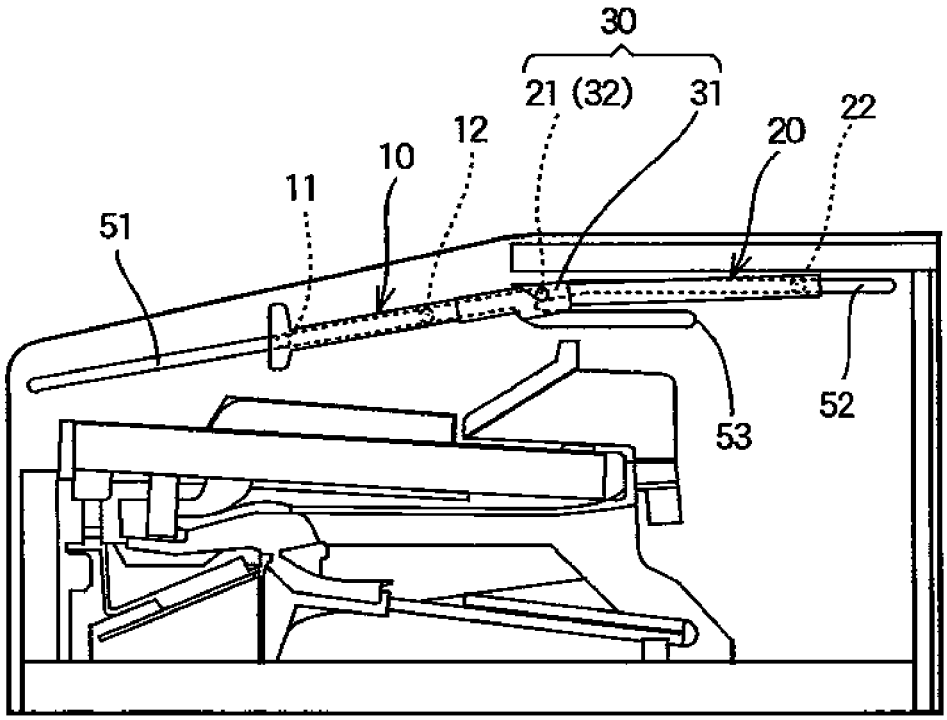
FIG. 6 is a longitudinal side sectional view of the electronic keyboard instrument depicted in FIG. 1, which shows a state that the keyboard lid is more opened.
Figure 7:
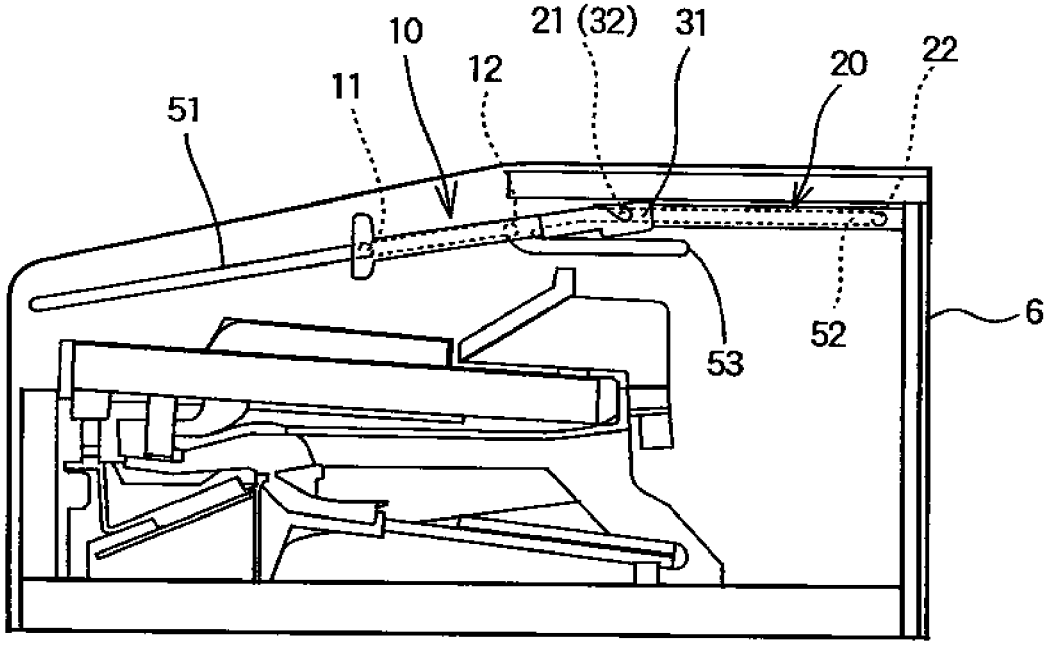
FIG. 7 is a longitudinal side sectional view of the electronic keyboard instrument depicted in FIG. 1, which shows a state in which the keyboard lid is more opened.

The guide recess 50 and the shafts 11, 12, 21 and 22 are mounted to have the following positional relation. In the state that the keyboard lid 1 is closed, as shown in FIG. 4, the front lid-front shaft 11, the front lid-rear shaft 12 and the rear lid-front shaft 21 are received in the first guide portion 51, and the rear lid-rear shaft 22 is received in the second guide portion 52. When opening the keyboard lid, because the rear end portion of the front lid section 10 is in contact with the front end portion of the rear lid section 20, if pushing the front end portion of the front lid section 10 rearward, the front and rear lid sections move rearward. FIGS. 5 to 7 show the state in the middle of opening the keyboard lid.

While performing the operation shown in FIG. 6 from the operation shown in FIG. 5, the rear lid-front shaft 21 passes through the branch point 55. At this time, because the front connecting piece 31 of the connecting part 30 supports the rear connecting piece 32 from the below, the rear lid-front shaft 21 does not descend to the third guide portion 53 from the branch point 55.

Figure 8:
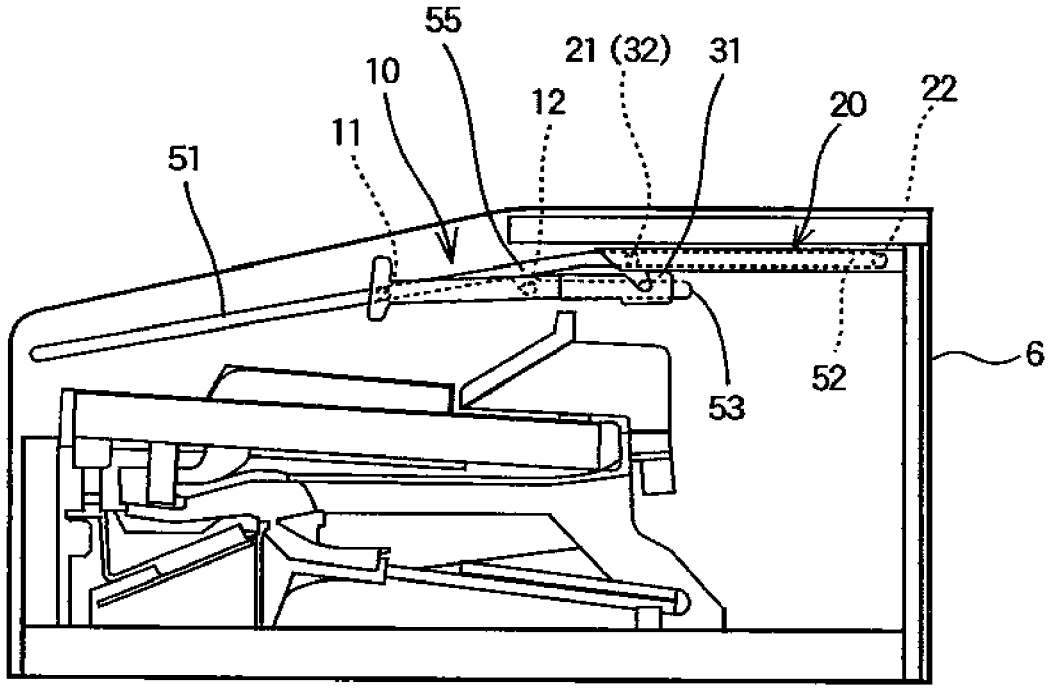
FIG. 8 is a longitudinal side sectional view of the electronic keyboard instrument depicted in FIG. 1, which shows a state in which the keyboard lid is more opened.

FIG. 7 shows the state in which the rear lid section 20 arrives at the rearmost position in which the rear end of the rear lid section 20 contacts the rear plate 6. At this time, the rear lid-rear shaft 22 and the rear lid-front shaft 21 are received in the second guide portion 52, and the front lid-rear shaft 12 is located at the branch point 55. As shown in FIG. 8, because the third guide portion 53 extends downward from the branch point 55, the front lid-rear shaft 12 moves to the third guide portion 53 by the weight of the front lid section 10. Accordingly, the rear portion of the front lid section 10 descends, and the front connecting piece 31 of the connecting part 30 is separated from the rear connecting piece 32, and the engagement is released.

Figure 11:
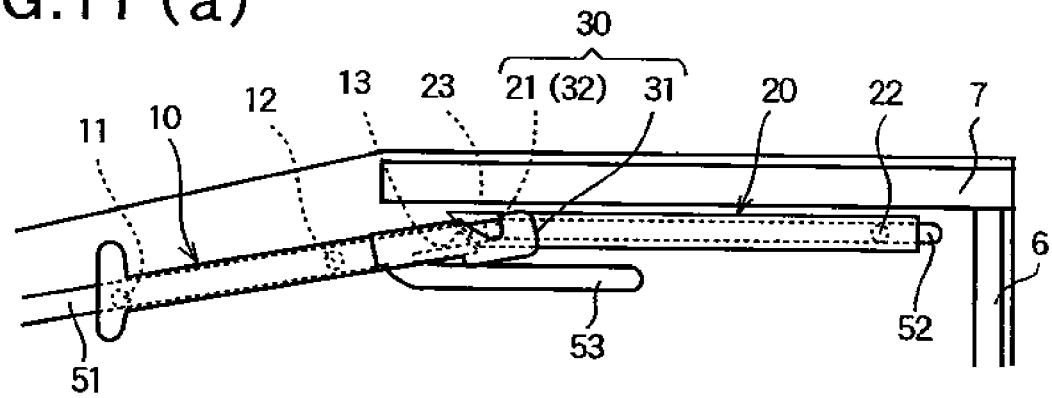
FIGS. 11(*a*)-11(*d*) are an explanation view showing a change of a connection state of a front lid section and a rear lid section in the electronic keyboard instrument depicted in FIG. 1.
Figure 11:
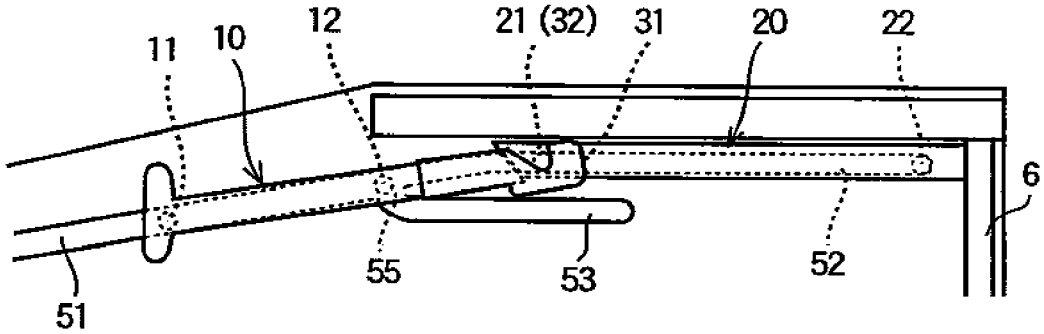
Figure 11:
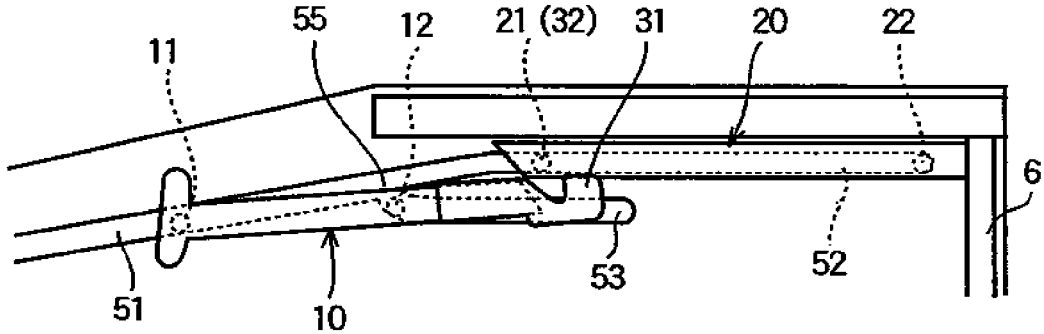
Figure 11:
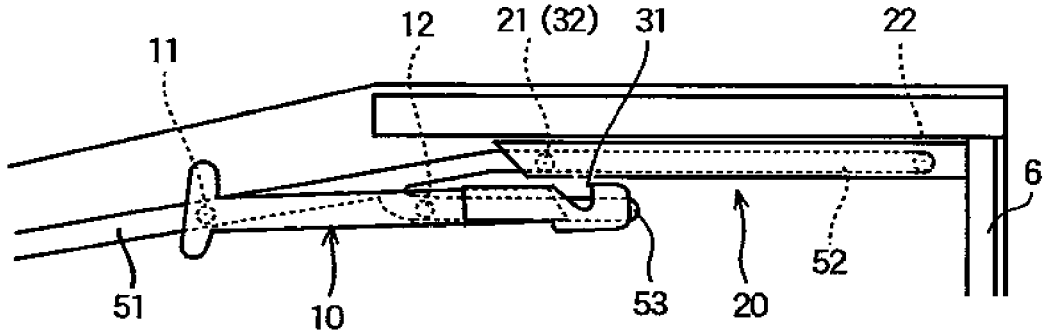

FIG. 11 shows a change process of the engagement state of the connecting part in detail. When opening the keyboard lid, a rear end portion 13 of the front lid section 10 comes into contact with a front end portion 23 of the rear lid section 20, and the rear lid section 20 is pushed by the rearward movement of the front lid section 10. FIG. 11(*a*) shows the state in which the front lid section 10 moves rearward and the front lid-rear shaft 12 approaches the branch point 55. FIG. 11(*b*) shows the state in which the rear lid section 20 reaches the rearmost position and the front lid-rear shaft 12 is located at the branch point 55. FIG. 11(*c*) shows the state in which the front lid-rear shaft 12 moves to the third guide portion 53 and the front connecting piece 31 of the connecting part 30 is separated from the rear connecting piece 32 to release the engagement. FIG. 11(*d*) shows the state in which the front lid section 10 moves more rearward.

Figure 9:
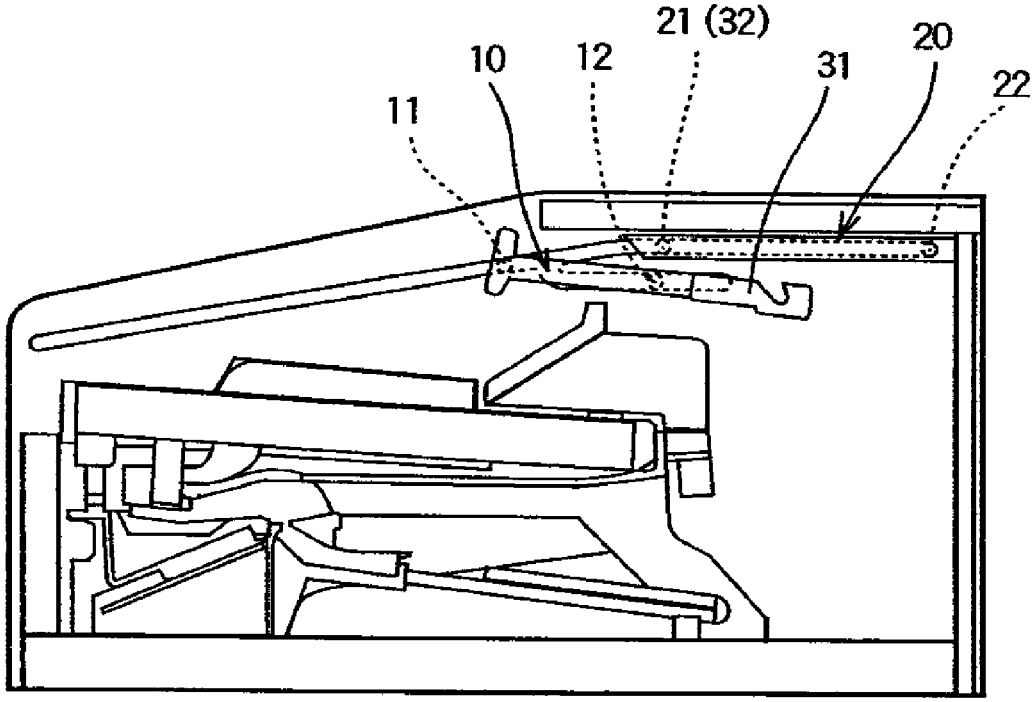
FIG. 9 is a longitudinal side sectional view of the electronic keyboard instrument depicted in FIG. 1, which shows a state in which the keyboard lid is more opened.
Figure 10:
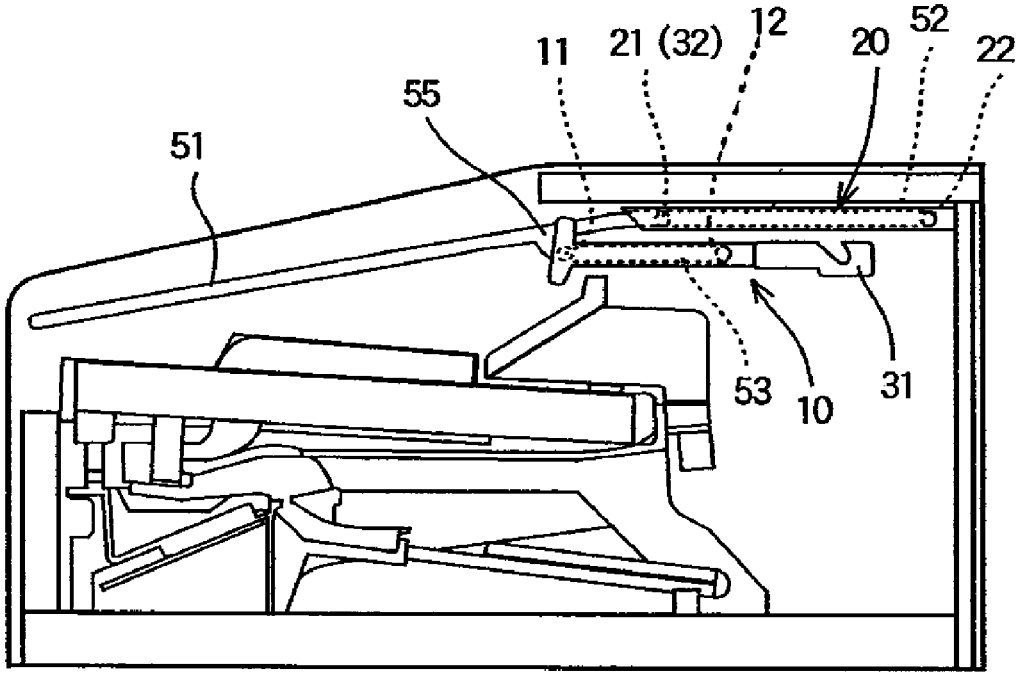
FIG. 10 is a longitudinal side sectional view of the electronic keyboard instrument depicted in FIG. 1, which shows a state in which the keyboard lid is fully opened.

As shown in FIG. 9, if more pushing the front lid section 10, the front lid section 10 is guided along the third guide portion 53. FIG. 10 shows the state in which the front lid-rear shaft 12 reaches the rearmost position in which the front lid-rear shaft 12 contacts the rear end of the third guide portion 53.

When closing the keyboard lid, a user moves the front lid section 10 forward. If doing so, the front lid-rear shaft 12 approaches the branch point 55 (FIG. 11(*d*)). The front lid-rear shaft 12 further progresses to ascend along the slant of the third guide portion 53, and the front connecting piece 31 of the connecting part 30 also ascends (FIG. 11(*c*)). If drawing the front lid section 10 more forward, the front lid-rear shaft 12 ascends to the branch point 55, and the front connecting piece 31 is engaged with the rear connecting piece 32 to make the connection state (FIG. 11(*b*)). In this state, if drawing the front lid section 10 more forward, the front lid-rear shaft 12 advances into the first guide portion 51, and the rear lid section 20 follows the front lid section 10 and moves forward along the first guide portion 51 (FIG. 11(*a*)). The rear lid-front shaft 21 further moves to advance into the first guide portion 51, and then the keyboard lid becomes again the closed state (FIG. 4).

According to the above keyboard lid and its supporting structure, if pushing the front lid section 10 rearward in order to open the keyboard lid 1 from the closed state, the rear lid section 20 is first received below the top plate 7, and the front lid section 10 is secondarily received below the rear lid section 20 by the continuous movement. Such a lid-receiving structure can shorten the depth of the musical instrument. In order to close the keyboard lid 1, the front lid section 10 is drawn from the space below the top plate 7. When the front lid section 10 is drawn to a certain extent, the rear lid section 20 is connected to the front lid section 10 by the connecting part 30 and is drawn together. Accordingly, when the front lid section 10 reaches the front end position, it becomes the state that the keyboard is adequately covered by the front and rear lid sections 10 and 20.

When closing the keyboard lid 1 from the state that the keyboard lid 1 is opened halfway, if the engagement of the connecting part 30 as shown in FIGS. 5 to 7 is maintained and the rear lid section 20 is connected to the front lid section 10, the rear lid section 20 also moves in the closing direction together with the front lid section 10. On the other hand, as shown in FIGS. 8 to 10, though the engagement of the connecting part 30 is released, the engagement of the connecting part 30 becomes made again when the rear lid-front shaft 21 returns to the branch point 55, so that the rear lid section 20 is connected to the front lid section 10 to be drawn together therewith. Accordingly, also when closing the keyboard lid 1 from the state that the keyboard lid 1 is opened halfway, a user can cover the keyboard adequately.

After the rear lid section 20 reaches the rearmost position, in order to secure the rearmost position, a shallow depression 52*e* may be provided downwardly from the rear end of the third guide portion 53, which is additionally illustrated in FIG. 3. When the rear lid section 20 reaches the rearmost position, the rear lid-rear shaft 22 is fitted into the depression 52*e* so as not to easily move forward, thereby securing the rearmost position. Because the depression 52*e* is formed shallow, if the rear lid section 20 is drawn to close the keyboard lid, the rear lid-rear shaft 22 escapes from the depression 52*e* and moves forward. By securing the rearmost position as described above, the position of the rear connecting piece 32 becomes stable. Further, when closing the keyboard lid, the rear lid-front shaft 21 can be more securely engaged with the front connecting piece 31.

Figure 12:
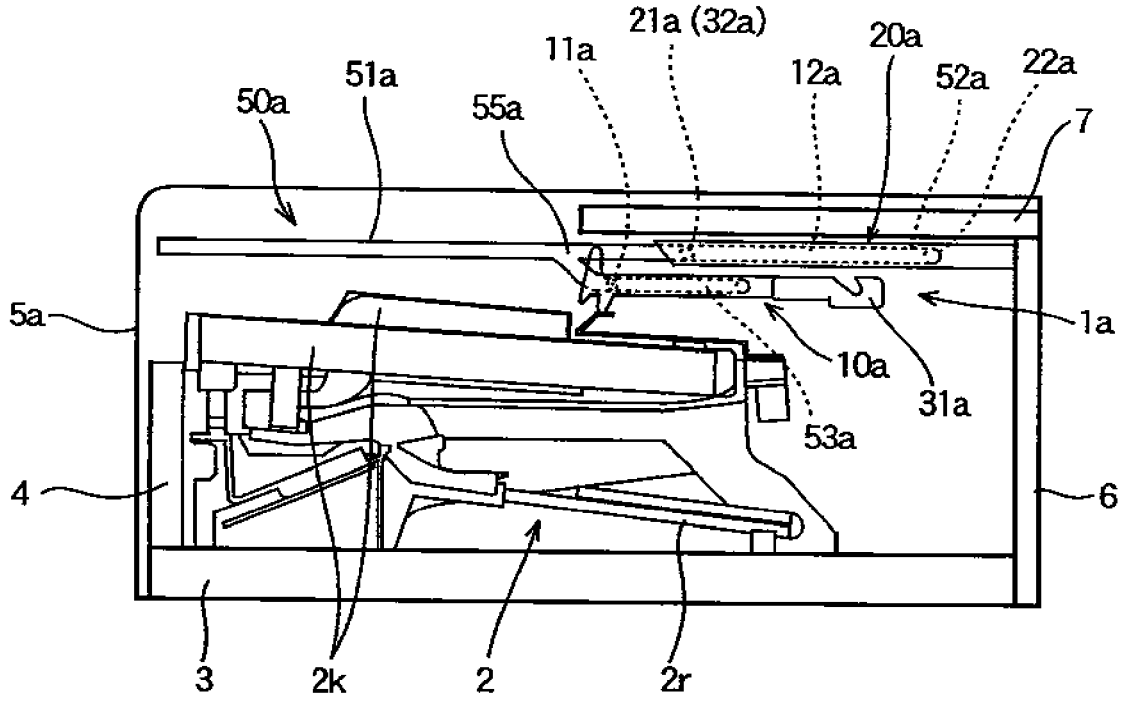
FIG. 12 is a longitudinal side sectional view of an electronic keyboard instrument in accordance with a second embodiment of the present invention, which shows a state that a keyboard lid is fully opened.

FIG. 12 shows a second embodiment of the present invention. In this embodiment, a first guide portion 51*a* of a guide recess 50*a* extends horizontally. A second guide portion 52*a* extends horizontally rearward from a branch point 55*a* at the rear end of the first guide portion 51*a*, and a third guide portion 53*a* is refracted from the branch point 55*a* in the slant rear-downward direction and then extends horizontally. Corresponding to the shape of the guide recess 50*a*,l a side plate 5*a* has an uppermost side which extends horizontally, and a front lid section 10*a* and a rear lid section 20*a* of a keyboard lid 1*a* are arranged horizontally. Other fundamental structures are the same as the previous embodiment.

In also this embodiment, when opening the keyboard lid 1*a*, a rear lid-front shaft 21*a* moves to the second guide portion 52*a*, a front lid-rear shaft 12*a* and a front lid-front shaft 11*a* move to the third guide portion 53*a* from the branch point 55*a*, and a front connecting piece 31*a* and a rear connecting piece 32*a* interlock with the above movement. The operation mechanism is the same as the previous embodiment. Accordingly, the lid-receiving structure such that the front lid section 10*a* is received below the rear lid section 20*a*, can shorten the depth of the musical instrument. Also when closing the keyboard lid 1*a* from the state that the keyboard lid 1*a* is opened halfway, a user can cover the keyboard adequately.

Furthermore, in this embodiment, because the keyboard lid 1*a*, the guide recess 50*a*, and the uppermost side of the side plate 5*a* are shaped horizontally, these components can be disposed near the height of the keyboard, and the height of the musical instrument can be lowered. As a result, with the reduction in the depth of the musical instrument, the whole musical instrument can be made very compactly.

The present invention is not restricted to the above embodiments, and can be diversely modified. For instance, the above embodiments are structured such that the rear connecting piece 32 of the connecting part 30 is also used as the rear lid-front shaft 21, however the rear connecting piece and the rear lid-front shaft may be separately mounted from each other.

The connecting part 30 of the above embodiments is configured such that the front connecting piece 31 is formed in a hook shape and the rear connecting piece 32 is formed as a pin, however contrary to the above configuration, the front connecting piece may be formed as a pin or other types of a locking piece and the rear connecting piece may be formed in a hook shape. In this case, in order for the front connecting piece to move downward from the branch point, the rear connecting piece is formed in a hook shape which is opened downward. By such a hook shape of the rear connecting piece, when the rear lid-front shaft reaches the branch point, the rear connecting piece (hook) is caught by the front connecting piece (pin, or the like) so that the front portion of the rear lid section is supported. Accordingly, the rear lid-front shaft can pass through the branch point without descending to the third guide portion. Also, both the front connecting piece and the rear connecting piece composing the connecting part may be formed in hook shapes which can be engaged with and separated from each other. In this case, in order to achieve the same operation as described above, the front connecting piece has an upwardly opened shape, and the rear connecting piece has a downwardly opened shape.

In the above embodiments, in the closed state of the keyboard lid, the rear lid-rear shaft is located in the second guide portion. However, the rear lid-rear shaft may be formed in a narrow and long shape which extends along the guide recess, so that the rear lid-rear shaft can move to the second guide portion without advancing into the third guide portion from the branch point. If structured like this, in the closed state of the keyboard lid, the rear lid-rear shaft can be located in the first guide portion.

Figure 13:
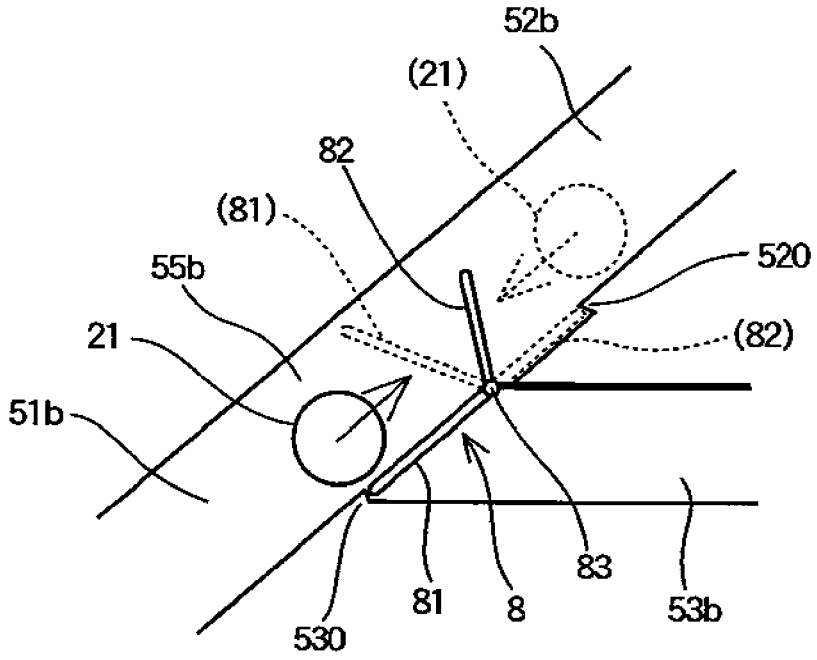
FIG. 13 is a side view showing a guide mechanism in a guide recess in accordance with another embodiment of the present invention.

In the above embodiments, the third guide portion has a shape such that it is refracted from the branch point in the slant rear-downward direction and then extends rearward, and the front lid-rear shaft descends to the third guide portion from the branch point by the weight of the front lid section. However, as shown in FIG. 13, a rotating element 8 may be mounted, so that when opening the keyboard lid, the rotating element 8 guides the rear lid-front shaft into the second guide portion from the branch point and guides the front lid-rear shaft into the third guide portion. By such a rotating element 8, the third guide portion can be formed to extend rearward without descending from the branch point. The rotating element 8 shown in the drawing includes a first piece 81 and a second piece 82 which make a predetermined angle therebetween and are rotatably mounted in the branch point by a rotating shaft 83. The rotational positions of the rotating element 8 are shown by a real line and a dotted line in FIG. 13. When the rotating element 8 is positioned as shown by the real line, the first piece 81 closes the third guide portion, and the second piece 82 closes the second guide portion. The rotating element 8 cannot be more rotated from the position shown by the real line in a left rotational direction on the drawing by a stopper (not shown). On the other hand, when the rotating element 8 is positioned as shown by the dotted line, the first piece 81 closes the second guide portion, and the second piece 82 is positioned along the second guide portion from the rotating shaft 83. The rotating element 8 cannot be more rotated from the position shown by the dotted line in a right rotational direction on the drawing by a stopper (not shown).

When opening the keyboard lid, the rear lid-front shaft 21 moves to the rear of the first guide portion 51*b*, and the rotating element 8 is positioned as shown by the real line. The rear lid-front shaft 21 collides with the second piece 82 to rotate the rotating element 8 to the position shown by the dotted line, and moves to the second guide portion 52*b*. Thereafter, when the front lid-rear shaft 12 and the front lid-front shaft 11 reach the branch point 55*b*, because the rotating element 8 is positioned as shown by the dotted line, the front lid-rear shaft 12 and the front lid-front shaft 11 are guided by the first piece 81 to move to the third guide portion 53*b*. When closing the keyboard lid, because the rotating element 8 is positioned as shown by the dotted line, the front lid-front shaft 11 and the front lid-rear shaft 12 move from the second guide portion 52*b* to the first guide portion 51*b* via the branch point 55*b*. Thereafter, if the rear lid-front shaft 21 moves forward from the second guide portion 52*b* and collides with the first piece 81, the rotating element 8 rotates to the position shown by the real line, and the rear lid-front shaft 21 moves to the first guide portion 51*b*. By the above operation, the keyboard lid can be opened and closed adequately. It is preferable to install a holding device to the rotating element 8 so that the rotating element 8 is held at the rotational positions shown by the real line and the dotted line and the holding force is released by the collision with the rear lid-front shaft 21. FIG. 13 shows that the third guide portion 53*b*and the second guide portion 52*b* are respectively formed with concave portions 530 and 520 in which the front end portions of the first piece 81 and the second piece 82 are respectively received and held, and a holding device which releases the holding force by the collision with the rear lid-front shaft 21 is mounted.

What is claimed is:

1. An electronic keyboard instrument comprising:

a musical instrument body which is provided with an array of keys at a front portion of the musical instrument body, and side plates at both side portions of the musical instrument body; and a keyboard lid which is mounted in the musical instrument body slidably between a closed position for covering the array of the keys and an open position for exposing the array of the keys, wherein the keyboard lid comprises a front lid section and a rear lid section which is arranged rearward of the front lid section in the closed position, and a connecting part which has connecting pieces respectively provided at the front lid section and the rear lid section to releasably connect the front lid section and the rear lid section to each other, the front lid section is provided with a front lid supporting part at each side end of the front lid section, and the rear lid section is provided with a rear lid supporting part at each side end of the rear lid section, each of the side plates is formed with a guide recess which extends from a front portion of the side plate to a rear portion of the side plate, and which receives the front lid supporting part and the rear lid supporting part to slidably support the keyboard lid, the guide recess comprises a first guide portion which is formed at the front portion of each of the side plates, a second guide portion which extends rearward from a branch point provided at a rear end of the first guide portion, and a third guide portion which extends rearward from the branch point below the second guide portion, under a state where the keyboard lid is placed in the closed position, the front lid supporting part and at least a portion of the rear lid supporting part are received in the first guide portion, and in case that the keyboard lid is shifted to the open position from the closed position, the front lid section moves rearward along the first guide portion together with the rear lid section, and when the rear lid section reaches a rearmost position, the rear lid supporting part is positioned in the second guide portion, while the front lid supporting part moves from the first guide portion to the third guide portion at the branch point according to release of the connection between the front lid section and the rear lid section by the connecting part, and subsequently the front lid section is guided along the third guide portion.

2. The electronic keyboard instrument according to claim 1, wherein in case that the keyboard lid is shifted to the closed position from the open position, the front lid section moves forward, and when the front lid supporting part advances into the first guide portion from the third guide portion, the front lid section is connected to the rear lid section by the connecting part, and the rear lid supporting part enters into the first guide portion following the front lid section, so that the front lid section and the rear lid section are guided along the first guide portion.

3. The electronic keyboard instrument according to claim 1, wherein the front lid supporting part comprises a front lid-front supporting part and a front lid-rear supporting part which are respectively mounted to a front portion and a rear portion of each side end of the front lid section, and the rear lid supporting part comprises a rear lid-front supporting part and a rear lid-rear supporting part which are respectively mounted to a front portion and a rear portion of each side end of the rear lid section, Under the state where the keyboard lid is placed in the closed position, the front lid-front supporting part, the front lid-rear supporting part and the rear lid-front supporting part are received in the first guide portion, and the rear lid-rear supporting part is received in the first guide portion or the second guide portion, and in case that the keyboard lid is shifted to the open position from the closed position, the rear lid section reaches the rearmost position to open the keyboard lid, and the rear lid-rear supporting part and the rear lid-front supporting part are positioned in the second guide portion, then the front lid-rear supporting part moves to the third guide portion from the branch point according to the release of the connection between the front lid section and the rear lid section by the connecting part, and subsequently the front lid section is guided along the third guide portion.

4. The electronic keyboard instrument according to claim 3, wherein in case that the keyboard lid is shifted to the closed position from the open position, the front lid-rear supporting part enters into the first guide portion from the third guide portion by moving the front lid section forward to close the keyboard lid, the front lid section is connected to the rear lid section to establish a connection state by the connecting part, and the rear lid-front supporting part enters into the first guide portion following the front lid section under the connection state, so that the front lid section and the rear lid section are guided along the first guide portion.

5. The electronic keyboard instrument according to claim 4, wherein the third guide portion slants downward from the branch point and then extends rearward, in case that the keyboard lid is shifted from the closed position to the open position, the front lid-rear supporting part descends to the third guide portion at the branch point, and the connection between the front lid section and the rear lid section by the connecting part is released due to the descending of the front lid-rear supporting part, and in case that the keyboard lid is shifted from the open position to the closed position, the front lid-rear supporting part ascends from the third guide portion, and enters into the first guide portion, and the connection between the front lid section and the rear lid section by the connecting part is established due to the ascending of the front lid-rear supporting part.

6. The electronic keyboard instrument according to claim 5, wherein the connecting part comprises a front connecting piece which is mounted to each of both side ends of the front lid section, and a rear connecting piece which is mounted to each side end of the rear lid section, the front connecting piece can be engaged with and separated from the rear connecting piece, the front connecting piece being connected to the rear connecting piece to draw the rear connecting piece forward in an engagement state, and otherwise being separated downward from the rear connecting piece, and the front connecting piece supports the rear lid-front supporting part from the below to prevent the rear lid-front supporting part from descending to the third guide portion when the rear lid-front supporting part is positioned in the branch point, and is disposed such that when the front lid-rear supporting part descends to the third guide portion from the branch point, the front connecting piece is separated from the rear connecting piece simultaneously with the descending of the front portion of the front lid section.

7. The electronic keyboard instrument according to claim 1, wherein the front lid section and the rear lid section are stored in a rear portion of the musical instrument body when the keyboard lid is placed in the open position, in such a manner that the front lid section and the rear lid section overlap with each other.

* * * * *